US009728365B2

(12) United States Patent
Kondo et al.

(10) Patent No.: US 9,728,365 B2
(45) Date of Patent: Aug. 8, 2017

(54) FUSE, FUSE BOX, AND FUSE DEVICE

(71) Applicant: Pacific Engineering Corporation, Ogaki-Shi, Gifu (JP)

(72) Inventors: Daiji Kondo, Ogaki (JP); Masahiro Kimura, Ogaki (JP)

(73) Assignee: Pacific Engineering Corporation, Gifu (JP)

( * ) Notice: Subject to any disclaimer, the term of this patent is extended or adjusted under 35 U.S.C. 154(b) by 0 days.

(21) Appl. No.: 14/511,554

(22) Filed: Oct. 10, 2014

(65) Prior Publication Data

US 2015/0102895 A1 Apr. 16, 2015

(30) Foreign Application Priority Data

Oct. 15, 2013 (JP) ..... 2013-214659

(51) Int. Cl.
*H01H 85/175* (2006.01)
*H01H 85/143* (2006.01)
*H01H 85/20* (2006.01)

(52) U.S. Cl.
CPC ..... *H01H 85/175* (2013.01); *H01H 85/2015* (2013.01); *H01H 2085/208* (2013.01)

(58) Field of Classification Search
CPC ..... H01H 85/175; H01H 85/2015; H01H 2085/208; H01H 85/0417; H01H 85/2035; H01H 2085/0555; H01H 2085/0233; H01H 2085/025; H01H 2085/2055; H01H 2085/2075; H01H 2085/2085; H01H 2085/209; H01H 85/0026
USPC ..... 337/186, 227, 158
See application file for complete search history.

(56) References Cited

U.S. PATENT DOCUMENTS 4,258,350 A * 3/1981 Watanabe ..... H01H 85/2045 337/198
5,257,951 A * 11/1993 Maeda ..... H01R 13/4361 439/752
5,314,354 A * 5/1994 Nomura ..... H01H 85/2045 439/620.27

(Continued)

FOREIGN PATENT DOCUMENTS

JP 2001-250466 A 9/2001
JP 2001-283711 A 10/2001

(Continued)

*Primary Examiner* — Jerry Wu
*Assistant Examiner* — Stephen Sul
(74) *Attorney, Agent, or Firm* — Shumaker, Loop & Kendrick, LLP

(57) ABSTRACT

Disclosed are a fuse, a fuse box, and a fuse device capable of preventing insertion of wrong products into the box or device and persistent electric arc. In certain aspects, the fuse includes a pair of electro-conductive terminals, a fuse element having a fusion portion provided between the electro-conductive terminals, and an insulating housing mounted so as to cover at least a part of the fusion portion and the electro-conductive terminals, wherein a notch is provided on a lower-end side of the insulating housing, the notch is located between the pair of electro-conductive terminals and at a position that does not interfere with the shape of the fusion portion provided between the pair of electro-conductive terminals, and the notch is formed in a manner that a protrusion provided in a fuse box for housing the fuse can be fitted therein.

7 Claims, 12 Drawing Sheets

(56) References Cited

U.S. PATENT DOCUMENTS

| | | | | | |
|---|---|---|---|---|---|
| 5,619,074 | A * | 4/1997 | Berch | B60R 25/04 | 180/287 |
| 5,662,496 | A * | 9/1997 | Kanamori | H01H 85/2035 | 337/186 |
| 5,816,858 | A * | 10/1998 | Kazarian | H01H 85/2045 | 439/366 |
| 2001/0028294 | A1 * | 10/2001 | Endo | H01H 85/0417 | 337/228 |
| 2002/0024414 | A1 * | 2/2002 | Sumida | H01H 85/0417 | 337/158 |
| 2002/0044038 | A1 * | 4/2002 | Andoh | H01H 85/0417 | 337/260 |
| 2009/0019971 | A1 * | 1/2009 | Obama | H01H 85/0208 | 81/3.8 |

FOREIGN PATENT DOCUMENTS

| | | | |
|---|---|---|---|
| JP | 2003-086073 | A | 3/2003 |
| JP | 2013-020354 | A | 1/2013 |

* cited by examiner

FUSE, FUSE BOX, AND FUSE DEVICE

CROSS-REFERENCE TO RELATED APPLICATION

This application claims priority from JP Patent Application No. 2013-214659 filed on Oct. 15, 2013, the entirety of which are incorporated herein by reference.

TECHNICAL FIELD AND BACKGROUND OF THE INVENTION

This application relates to fuses for use in, for example, electric circuits for automobiles.

Conventionally, fuses are used to protect electric circuits installed in automobiles, and in electric and electronic components connected to the electric circuits. More particularly, when overcurrent unexpectedly flows in an electric circuit, heat generated by the overcurrent blows the fusion portion of a fuse in order to block the overcurrent from flowing through to respective electric and electronic components.

There are various types of known fuses, one of which is a fuse 800 disclosed in JP Application No. 2013-020354, which is illustrated in FIG. 6A.

The fuse 800 disclosed in JP Application No. 2013-020354 has characteristics modified by welding a low-melting metal 823 to a part of a fusion portion 820 housed in an insulating housing 830 so that the low-melting metal 823 serves to, for example, better control temperature increases and improve durability.

However, since no change is made to the overall shape of the fuse 800 except that the low-melting metal 823 is welded to a part of the fusion portion 820 housed in the insulating housing 830, the fuse 800 is indistinguishable from the conventional fuses. The worst case scenario when a fuse with different fuse characteristics is mistakenly put in a fuse box would be that electric wires in the fuse box are burnt or broken.

Moreover, insertion of a fuse with different fuse characteristics in a fuse box for a high voltage circuit would involve the risk that overcurrent flows and blows the fusion portion of the inserted fuse, generating electric arc between sections of the blown fusion portion.

FIGS. 6B and 6C respectively illustrate a fuse 900A and a fuse 900B disclosed in JP Application No. 2000-058691 and JP Application No. 2000-099745 with an aim to prevent insertion of wrong products.

In these fuses, as illustrated in FIGS. 6B and 6C, their insulating housings in part, and housings of fuse boxes have modified shapes.

More specifically, because of its insulating housing 930A having a shape corresponding to that of the housing 950A, the fuse 900A of FIG. 63 can be directly inserted in the housing 950A. On the other hand, the fuse 900B of FIG. 6C is different from the fuse of FIG. 6B. Specifically, protrusions 931B are provided on both side surfaces of an insulating housing 930B, and a housing 950B has a modified, substantially rectangular shape corresponding to the shape of the insulating housing 930B.

An attempt to mistakenly insert the fuse 900B of FIG. 6C into the housing 950A of FIG. 6B would fail since the protrusions 931B on the side surfaces of the insulating housing 930B abut against the upper end of the housing 950A. In this way, it is prevented to mistakenly insert wrong products having different characteristics by modifying the shapes of their fuse housings and housings of fuse boxes.

FIG. 6D illustrates a fuse 1000 disclosed in JP Application No. 2001-273994, which has a blocking wall to block persisting electric arc.

When overcurrent flowing in the fuse 1000 blows a fusion portion 1020, electric arc may be generated between two root portions 1021 left with the blown fusion portion. However, a blocking wall 1031, which is formed in an insulating housing 1030 at a position between the two root portions 1021, can physically block persisting electric arc.

Although the fuses 900A, 900B, and 1000 disclosed in JP Application No. 2000-058691, JP Application No. 2000-099745, and JP Application No. 2001-273994 may prevent the insertion of wrong products or the occurrence of persisting electric arc, these structures are overly complex and expensive to manufacture.

SUMMARY OF THE INVENTION

Therefore, a simple-structured fuse capable of preventing insertion into wrong products and the occurrence of persisting electric arc has been long-awaited. The disclosed fuse, fuse box, and fuse device are simply-structured and able to prevent both insertion of wrong products and occurrence of persisting electric arc.

The disclosed fuse may include a pair of electro-conductive terminals, a fuse element having a fusion portion provided between the electro-conductive terminals, and an insulating housing mounted so as to cover at least a part of the fusion portion and the electro-conductive terminals, wherein a notch is provided on a lower-end side of the insulating housing, the notch is located between the pair of electro-conductive terminals and at a position that does not interfere with the shape of the fusion portion provided between the pair of electro-conductive terminals, and the notch is formed in a manner that a protrusion provided in a fuse box for housing the fuse can be fitted therein.

The fuse has a notch that allows the protrusion of the fuse box to be fitted therein. Thus, the fuse can be inserted in the housing of the fuse box. On the other hand, an attempt to insert any fuse not provided with such a notch is blocked by the protrusion. This prevents any fuses lacking such a notch to be mistakenly inserted in the housing of the fuse box.

Additionally, overcurrent, if flowing in the fuse, blows the fusion portion, leaving connecting portions at both ends thereof. The notch is located between the connecting portions on both sides, and the protrusion of the fuse box fitted in the notch is accordingly located between these connecting portions. Therefore, the protrusion of the fuse box fitted in the notch can block (prevent) persisting electric arc generated between the connecting portions. The notch is located at a position that does not interfere with the shape of the fusion portion provided between the pair of electro-conductive terminals. This eliminates the risk of any contact between the protrusion of the fuse box and the fusion portion even when the protrusion is fitted in the notch.

With this simple structure, it is possible to prevent insertion of wrong products while concurrently preventing the occurrence of persistent electric arc.

The fuse according to the invention of this application is characterized in that the notch is located at the center of the insulating housing.

By virtue of the notch located at the center of the insulating housing, the fuse can be inserted well in the housing of the fuse box irrespective of the directions of the front and rear sides of the fuse.

The disclosed fuse box is provided with a housing that houses the fuse, wherein a protrusion having a shape corresponding to the notch of the fuse is provided so that the protrusion is fitted in the notch of the fuse when the fuse is housed in the housing.

The fuse box is thus provided with the protrusion whose shape corresponds to the notch of the fuse. This allows the fuse with the notch to be inserted therein, while also serving to block insertion of any fuses lacking such a notch. Even in a case where the fusion portion of the inserted fuse is blown, the protrusion of the fuse box, in turn, blocks persisting electric arc.

A fuse device according to the invention of this application includes the fuse and the fuse box.

The fuse device is simply-structured and able to prevent both insertion of wrong products and occurrence of persisting electric arc. Therefore, an automobile electric circuit or the like mounted with the fuse device can be protected from electric arc and overcurrent that may result from mistakenly inserting any wrong fuses.

As described above, the disclosed fuses, fuse box, and fuse devices can prevent both the insertion of wrong products and occurrence of persisting electric arc.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

Hereinafter, embodiments of the invention of this application are described referring to the accompanying drawings. As to shapes and materials of structural members of a fuse, fuse box, and a fuse device, the embodiments only present non-limiting examples given purely as illustrative. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
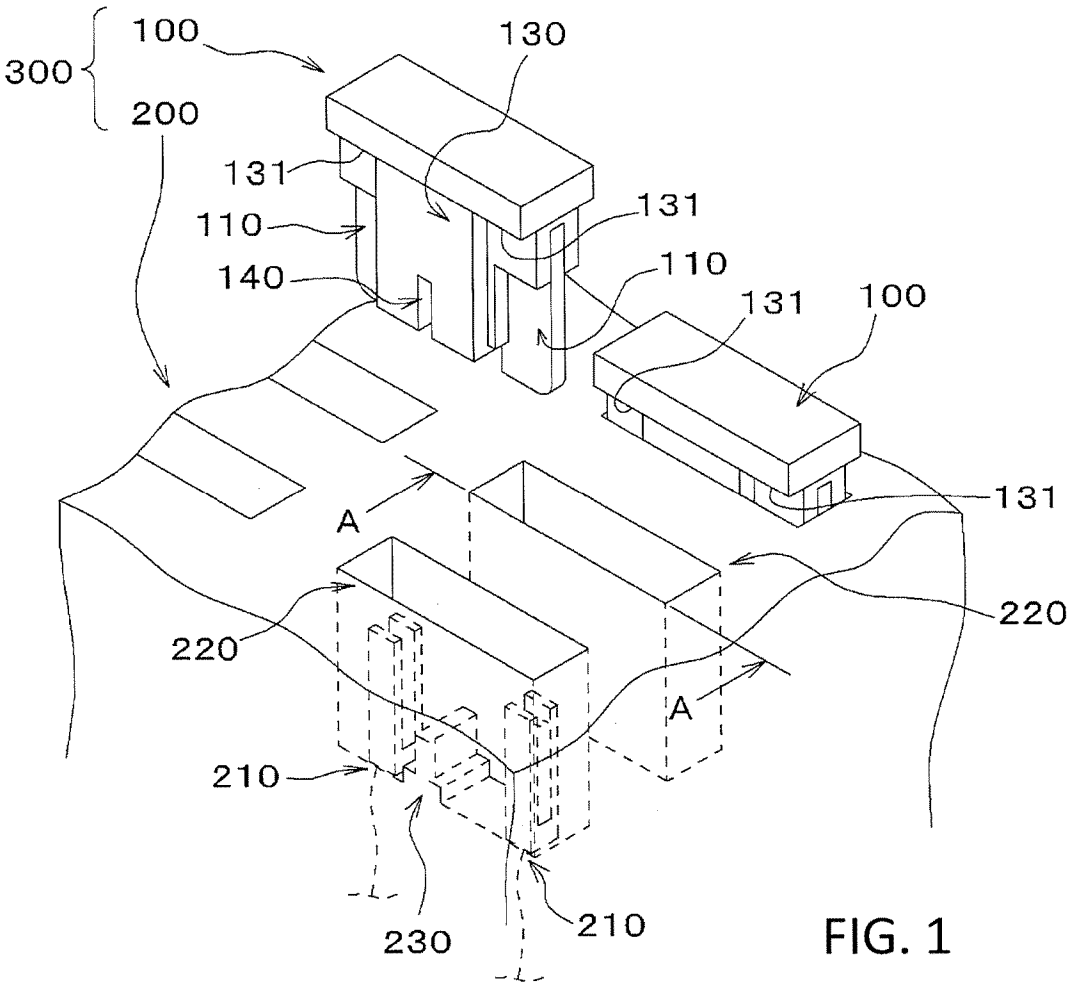
FIG. 1 is a perspective view of a fuse, a fuse box, and a fuse device according to the invention.

FIG. 1 is a perspective view illustrating an overall structure of a fuse device 300 including a fuse 100 and a fuse box 200 according to the invention of this application. The fuse device 300 is connected to, for example, an electric circuit for automobiles or the like. When overcurrent unexpectedly flows in the electric circuit, the fuse protects respective electric and electronic components by blocking further flow of the overcurrent into these components.

More specifically, the fuse device 300 is installed in, for example, an automobile with connection terminals 210 of the fuse box 200 being connected to an electric circuit. When the fuse 100 is inserted in a housing 220 of the fuse box 200, electro-conductive terminals 110 at both ends of the fuse 100 are connected to the connection terminals 210. In the event that overcurrent unexpectedly flows in the electric circuit, a fusion portion 120 (see FIG. 2D) provided between the electro-conductive terminals 110 of the fuse 100 blows, blocking the current flow.

Though details will be given later, a notch 140 is provided on the lower-end side of an insulating housing 130 of the fuse 100. The notch 140 is formed in a manner that a protrusion 230 protruding from the bottom surface of the housing 220 can be fitted therein. Therefore, the fuse 100 can be inserted in the housing 220 all the way to its bottom surface.

Along with, for example, downsizing of the fuse 100 and the fuse box 200 and increase of electric and electronic components, the fuse box 200 may have a number of housings 220 so that multiple fuses 100 can be inserted therein. In this case, a fuse clip is generally used to facilitate insertion and removal of the fuse 100. The fuse clip (not illustrated) has claws formed at an edge thereof. The fuse 100 can be inserted and removed by engaging the claws with recesses 131 formed on the upper-end side of the insulating housing 130 of the fuse 100.

The body of the fuse box 200 and the protrusion 230 are integrally formed by injection molding or the like from materials with electrical insulating properties, examples of which are nylon resins and polypropylene resins. The connection terminals 210 are made of a metallic material so as to establish electrical connection between the electric circuit and the fuse.

Next, structural features of the fuse 100 according to the invention of this application are described in detail referring to FIG. 2. The fuse 100 includes the insulating housing 130 and a fuse element 150. FIG. 2A is a front view of the insulating housing 130. FIG. 2B is a bottom view of the insulating housing 130. FIG. 2C is a front view of the fuse element 150.

Figure 2B:
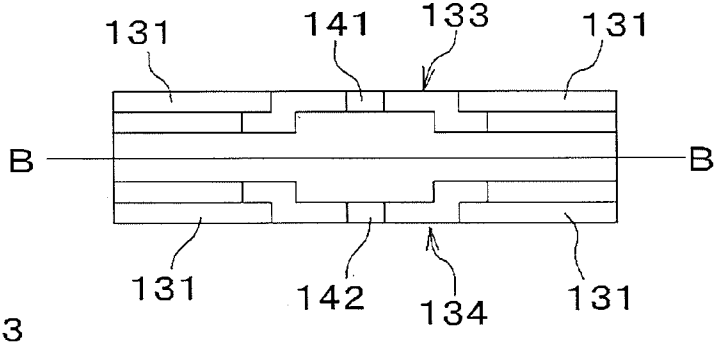
FIG. 2B is a bottom view of the insulating housing.
Figure 2A:
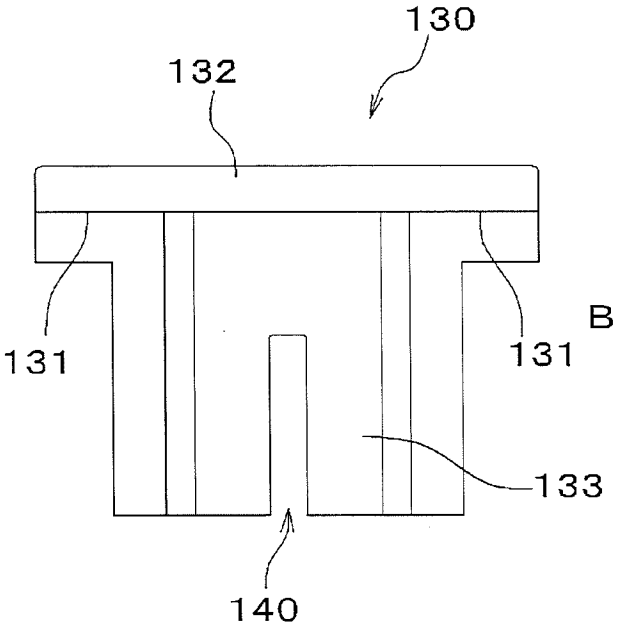
FIG. 2A is a front view of an insulating housing of the fuse according to the invention.

Describing the shape of the insulating housing 130 referring to FIGS. 2A and 2B, its front wall 133 and rear wall 134 are coupled with an upper wall 132, and its lower side has an opening shape. The linearly formed notch 140 extending from the lower end toward the upper end of the insulating housing 130 is provided on the lower-end side of the insulating housing 130.

More specifically, the notch 140 includes a front-side notch 141 formed at the center of a lower end part of the front wall 133, and a rear-side notch 142 formed at the center of a lower end part of the rear wall 134. The front-side notch 141 and the rear-side notch 142 are provided at bilaterally symmetric positions centered on line B-B. Therefore, the protrusion 230 in the form of a rectangular parallelepiped (see FIG. 1) can be fitted in the front-side notch 141 and the rear-side notch 142 in a straddling manner.

In the presence of the recesses 131 provided at four corners of the upper wall 132, the fuse 100 can be inserted and removed more reliably by engageably thrusting the four claws of the fuse clip into the recesses 131.

The insulating housing 130 is integrally formed by injection molding from materials with electrical insulating properties, examples of which are nylon resins, polycarbonate resins, or polyethersulfone resins. The method of integral formation is not limited to injection molding, and may be suitably selected from other methods, for example, by assembling separately formed walls into the overall shape of the insulating housing 130.

Figure 2D:
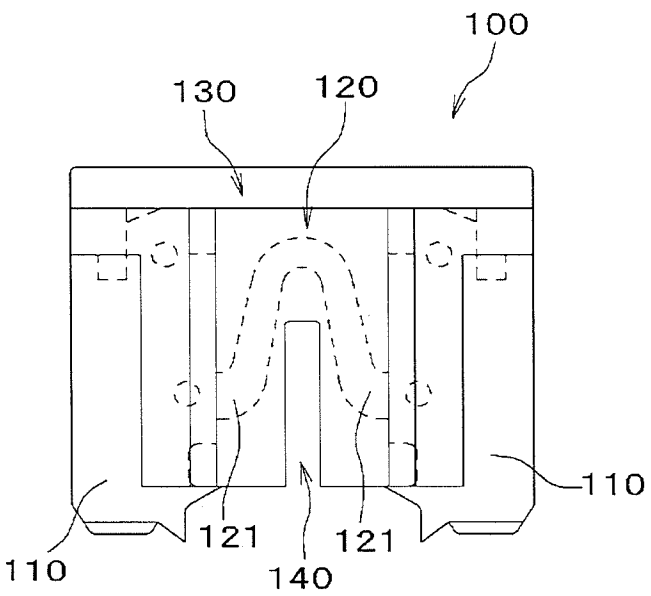
FIG. 2D is a front view of the fuse according to the invention.
Figure 2C:
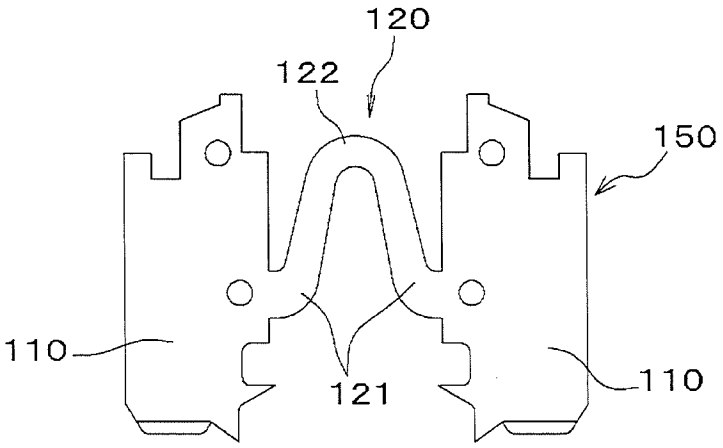
FIG. 2C is a front view of a fuse element of the fuse according to the invention.

As illustrated in FIG. 2C, the fuse element 150 includes the paired electro-conductive terminals 110 which are in the form of a thin plate and aligned in parallel with each other, and the fusion portion 120 thinly formed and provided between the electro-conductive terminals 110. The fusion portion 120 has connecting portions 121 at both ends thereof and a center part 122. The connecting portions 121 are fixed to the electro-conductive terminals 110, and the center part 122 is curved in a substantially U shape.

The shape of the fusion portion 120 is not limited to the substantially U shape and may be suitably selected from various shapes depending on, for example, rated current and fusion time. The materials of the electro-conductive terminal 110 and the fusion portion 120 are, for example, zinc, copper, nickel, aluminum, silver, or alloys thereof.

Figure 2E:
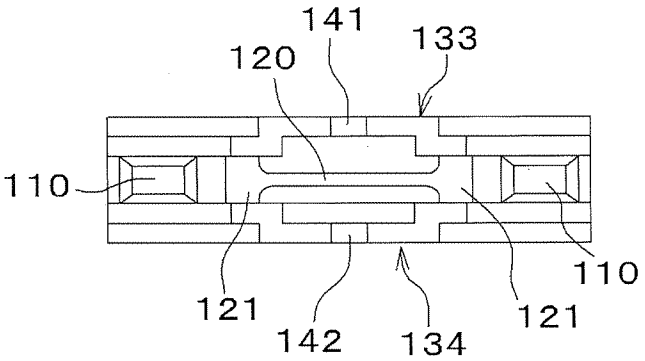
FIG. 2E is a bottom view of the fuse.

FIG. 2D is a front view of the fuse 100 obtained by mounting the fuse element 150 in the insulating housing 130. FIG. 2E is a bottom view of the fuse 100 thus obtained.

The fuse element 150 is inserted into the insulating housing 130 through its lower-end opening and mounted therein to obtain the fuse 100. Then, the fusion portion 120 of the fuse element 150 is housed in the insulating housing 130 and thereby protected from an external environment. Further, the electro-conductive terminals 110 of the fuse element 150 are, in part, exposed from the insulating housing 130, which allows these terminals to be connected to the connection terminals 210 of the fuse box 200 (see FIG. 1).

The notch 140 is located between the connecting portions 121 and at a position downward somewhat spaced from the fusion portion 120, which is a position at which interference with the fusion portion 120 can be avoided as illustrated in FIG. 2D. As a result of this arrangement, when the protrusion 230 of the fuse box 200 is fitted in the notch 140, the protrusion 230 is located between the connecting positions 121 without any contact with the fusion portion 120.

Figure 3A:
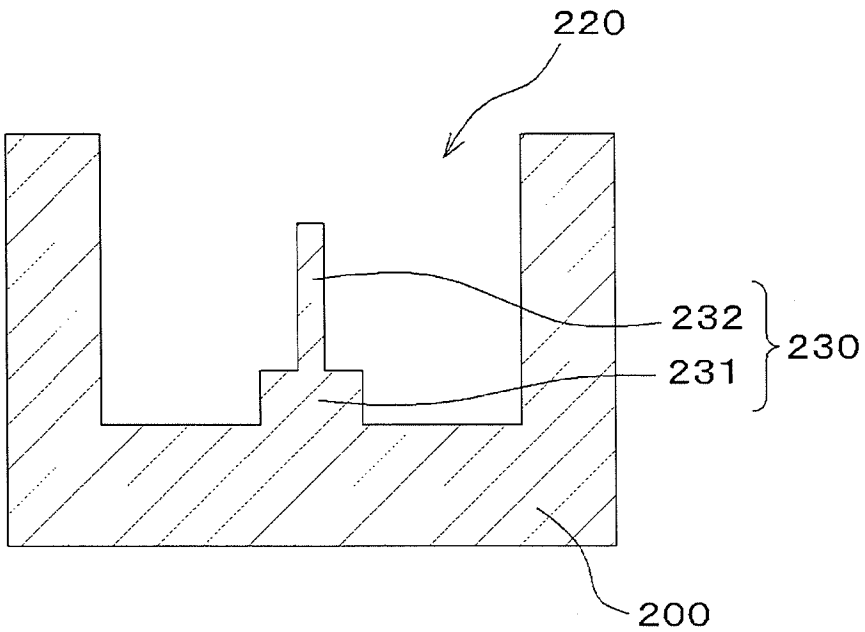
FIG. 3A is an enlarged sectional view of a housing cut along line A-A of FIG. 1.

FIG. 3A is an enlarged sectional view of the housing 220 cut along line A-A of FIG. 1. The housing 220 is a groove substantially rectangular in longitudinal cross section, which is large enough to accommodate the fuse 100. The protrusion 230 is formed at the center of the bottom surface of the housing 220. The protrusion 230 includes a lower-step protrusion 231 and an upper-stage protrusion 232 formed on the lower-step protrusion 231.

Figure 3B:
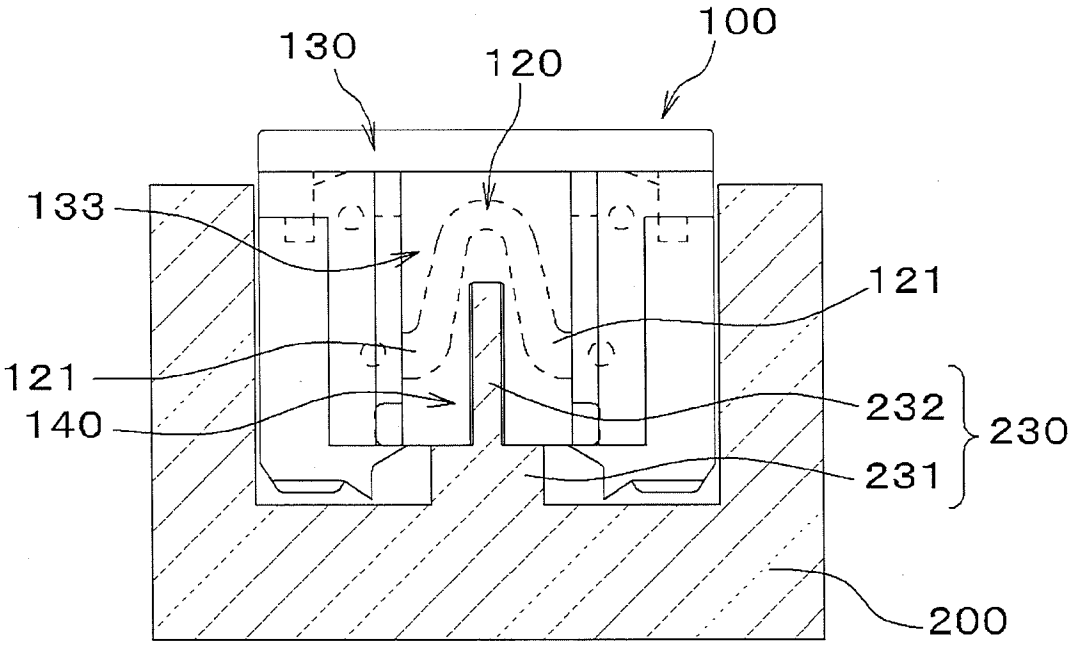
FIG. 3B is a drawing of the housing illustrated in FIG. 3A with the fuse according to the invention being inserted therein.

FIG. 3B illustrates the housing 220 with the fuse 100 being inserted therein. The shape of the upper-stage protrusion 232 in cross section has a shape that corresponds to that of the notch 140 of the fuse 100 as illustrated in FIG. 3B. The upper-stage protrusion 232 thus formed can be suitably fitted in the notch. Therefore, the fuse 100 can be reliably inserted into the housing 220 all the way to a position at which the lower end of the insulating housing 130 contacts the lower-stage protrusion 231.

Figure 3C:
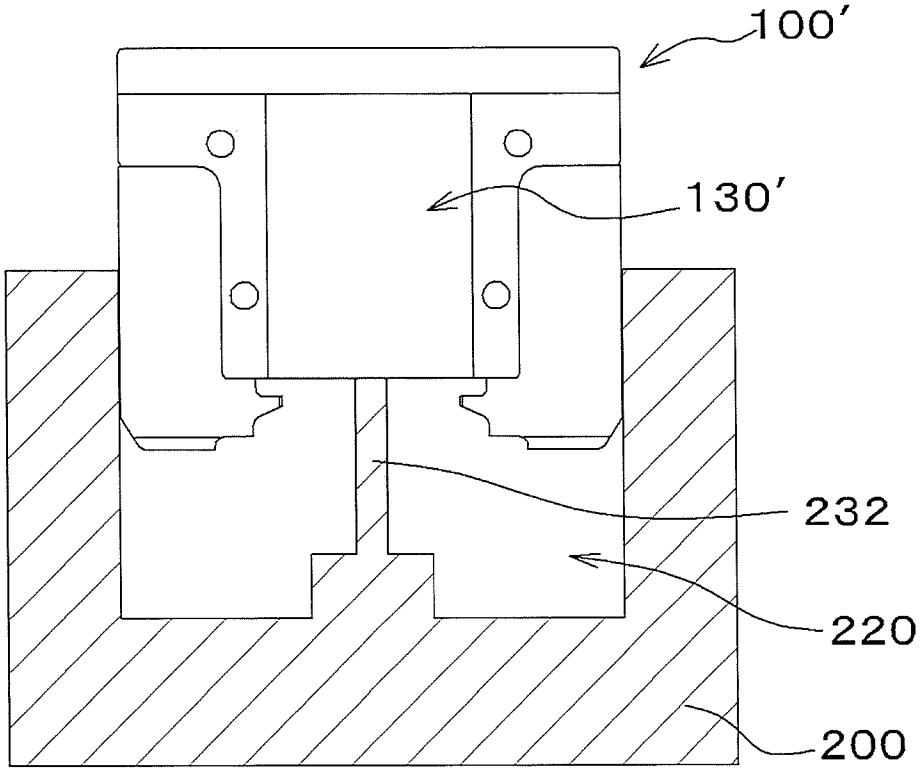
FIG. 3C is a drawing of the housing illustrated in FIG. 3A in an attempt to insert a conventional fuse lacking a notch.

On the other hand, an attempt to insert a conventional fuse 100' lacking such a notch 140 into the housing 220, as illustrated in FIG. 3C, fails since the lower end of an insulating housing 130' of the conventional fuse 100' abuts against the upper end of the upper-stage protrusion 232.

Thus, the housing 220 can only accommodate the fuse 100 with the notch 140 that allows the protrusion 230 to be fitted therein. In the meantime, it can be prevented that the conventional fuse 100' lacking such a notch 140 is mistakenly inserted in the housing 220.

Figure 6B:
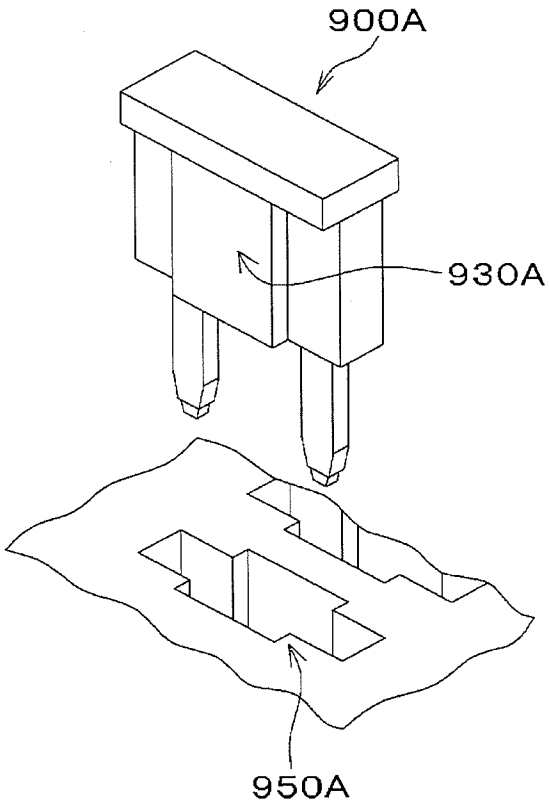
FIGS. 6A to 6D are illustrations of a conventional fuse.
Figure 6A:
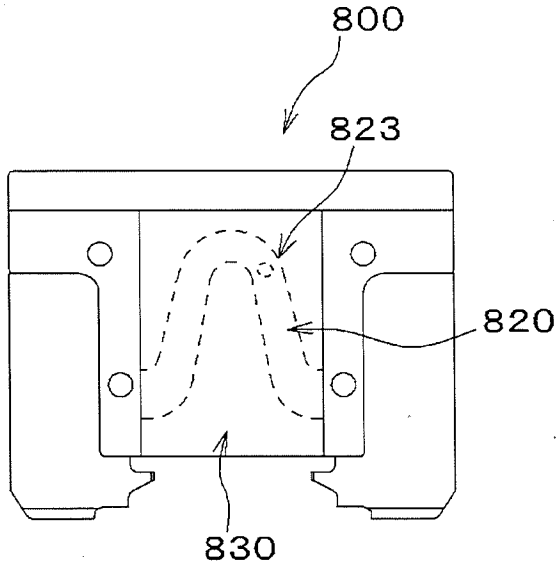
Figure 6D:
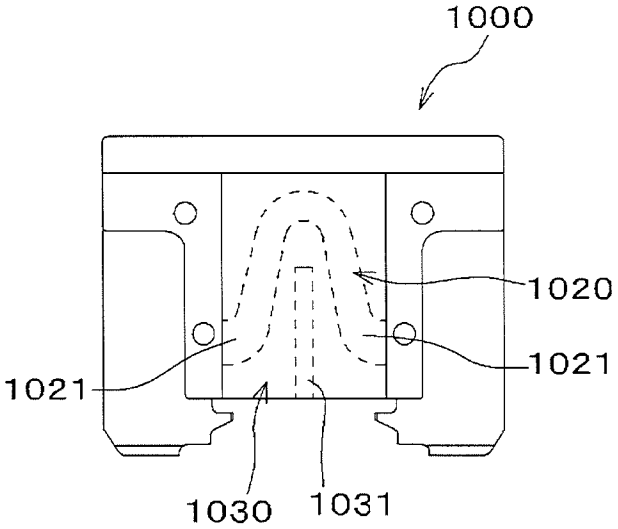
Figure 6C:
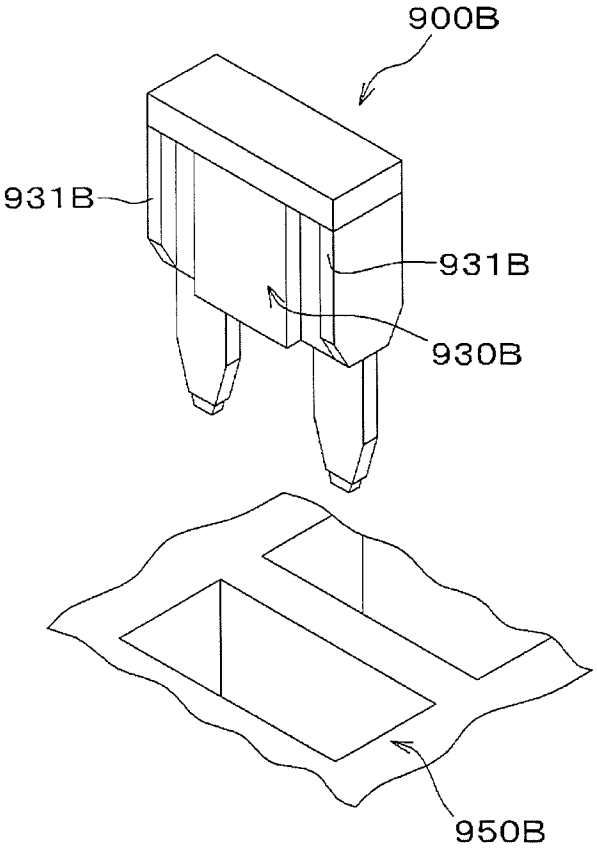

In the conventional fuse, both side surfaces of the insulating housing 930B are provided with the protrusions 931B extending from the lower end to the upper end of the housing as illustrated in FIG. 6C. Conventionally, injection molding is employed for the formation of the housing 930B. The protrusions 931B are formed from the lower end to the upper end of the insulating housing 930B so that the insulating housing 930B formed by injecting molding can be easily pushed upward and removed from a cast.

However, recesses with which a fuse clip is to be engaged are provided on the upper-end side of the insulating housing. Therefore, any changes in the upper-end shape of the housing to prevent insertion of wrong products may result in failure to engage the fuse clip with the recesses. According to the fuse of the invention of this application, insertion of wrong products is prevented by the notch formed on the lower-end side of the insulating housing as an alternative for any changes to the upper-end shape of the insulating housing. Because the recesses provided on the upper-end side of the insulating housing remain the same in shape, the fuse clip can be engaged with the recesses as conventionally done.

In FIG. 3B, the protrusion 230 is located at a position at the center of the bottom surface of the housing 220, and the notch 140 is located at a position at the center of the lower-end part of the insulating housing 130. However, the protrusion and the notch are not necessarily located at these positions.

For example, if the connecting portions 121 on both sides are more spaced from each other than the illustration of FIG. 3B, the protrusion 230 and the notch 140 may be located at arbitrary positions displaced to right or left on the condition that the protrusion 230 does not contact the fusion portion 120. In that case, when the fuse 100 is inserted in the housing 220, it is necessary to confirm directions of front and rear sides of the fuse 100 to ensure that the notch 140 of the fuse 100 and the protrusion 230 are located opposite to each other.

The fuse 100 can be inserted in the housing 220 irrespective of the directions of the front and rear sides of the fuse 100 by providing the notch 140 and the protrusion 230 at the respective center positions as illustrated in FIG. 3B.

It is illustrated in FIG. 3B that the fuse 100 is inserted in the housing 220 with the front wall 133 of the insulating housing 130 being directed toward the near side on the drawing. Inserting the fuse 100 into the housing 220 with the front and rear sides of the fuse 100 being reversed, meaning that the front wall 133 is directed toward the far side on the drawing (in other words, the rear wall 134 of the insulating housing 130 is directed toward the near side on the drawing), the fuse 100 can still be inserted as-is into the housing 220 because of the same positional relationship between the notch 140 and the protrusion 230 both located at the center positions. Thus, the fuse 100 is successfully inserted in the housing 220 irrespective of the directions of the front and rear sides of the fuse 100.

Figure 4:
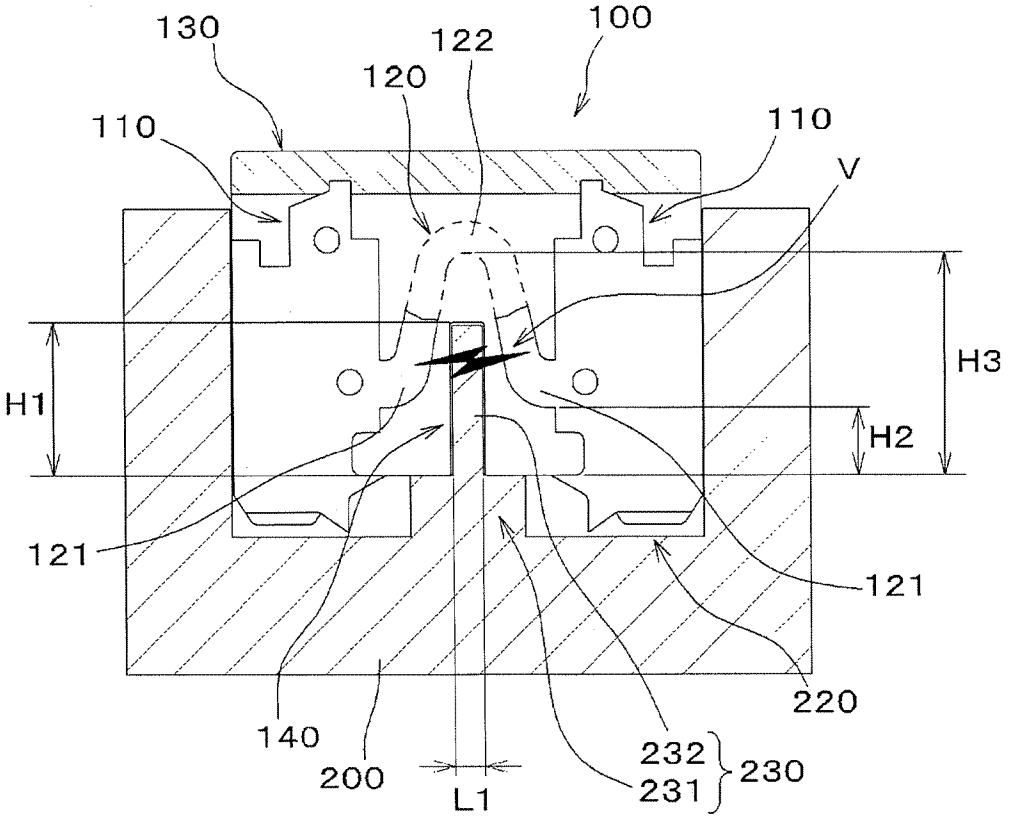
FIG. 4 is a conceptual view of the fuse according to the invention housed in the housing in which a fusion portion has been blown.

FIG. 4 is a conceptual view of the fuse 100 inserted in the housing 220 in which the fusion portion 120 has been blown.

Assuming that overcurrent flows with the fuse 100 being inserted in the housing 220 and blows the center part 122 of the fusion portion 120 as illustrated in FIG. 4, the left and right electro-conductive terminals 110 are left with the connecting portions 121 of the fusion portion 120. Even after the fusion portion 120 is only partly blown, an electric arc V may still occur and stay on between the connecting portions 121 due to, for example, high voltages that may be unexpectedly applied to the electric circuit. However, the upper-stage protrusion 232 located between the connecting portions 121 physically blocks the electric arc V generated between the connecting portions 121 and prevents the electric arc V from persisting.

It is illustrated in FIG. 4 that the fusion portion 120 has a substantially U-shaped curve, and the notch 140 and the protrusion 230 are located below the inside of the curve. However, the shape of the fusion portion 120 is not necessarily limited thereto. For example, the fusion portion 120 may have a substantially M shape (a shape formed by continuously arranging two fusion portions 120 having a substantially U shape), the notch 140 and the protrusion 230 may be respectively provided below the inside of the curve.

As illustrated in FIG. 4, the notch 140 and the upper-stage protrusion 232 have a rectangular shape with a height H1 and a width L1 in longitudinal section. However, they are not necessarily formed in such a shape. The width L1 may be changed on the condition that it does not contact the connecting portions 121 on both sides. The height H1 may be changed on the condition that the height H1 is larger than a height H2 measured from the lower end of the insulating housing 130 to the lower end of the connecting portion 121 and smaller than a height H3 measured from the lower end of the insulating housing 130 to the lower end of the center part 122 of the fusion portion 120. To enable the fusion portion 120 to exert its desirable characteristics, it is necessary that the upper-stage protrusion 232 should not be in contact with or too close to the fusion portion 120, instead, should keep an appropriate distance to the fusion portion 120.

Modified Example 1

Hereinafter, a fuse 400 and a fuse box 500 according to a modified example 1 are described referring to FIG. 5A, in which shapes of a notch and a protrusion are modified. The fuse 400 and the fuse box 500 respectively have a notch 440 and a protrusion 530 that are different from the notch 140 of the fuse 100 and the protrusion 230 of the fuse box 200. Any other structural features of these fuse and fuse box are identical to those of the fuse 100 and the fuse box 200. Descriptions of identical structural features are omitted.

Figure 5A:
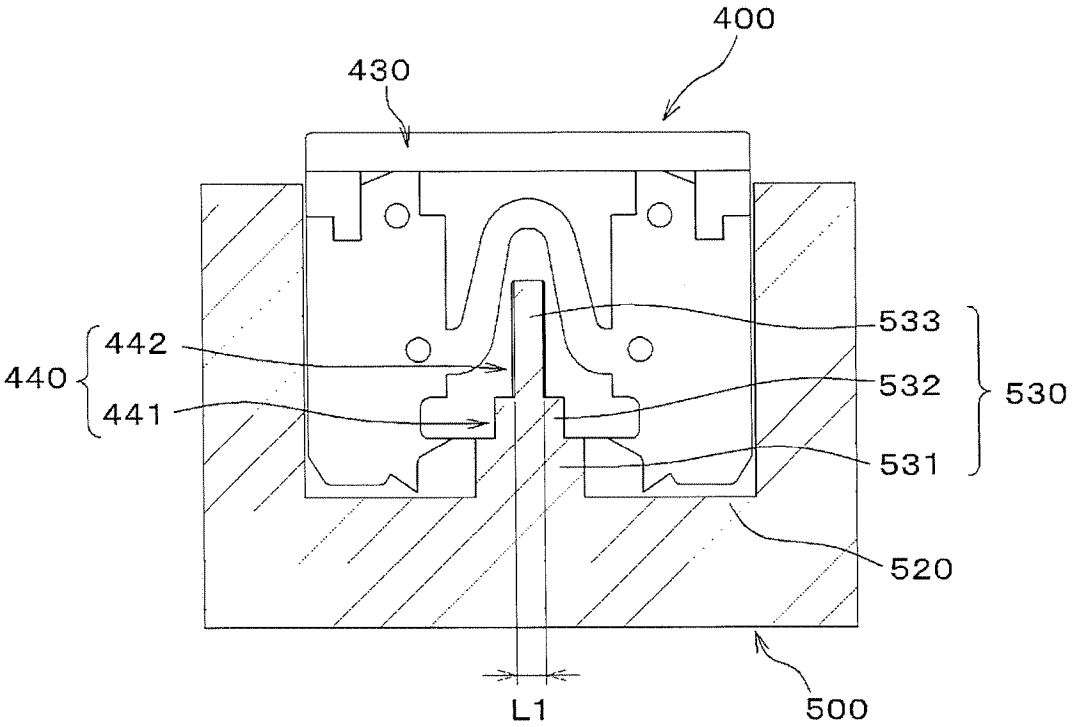
FIG. 5A is an enlarged view of a fuse and a fuse box according to a modified example 1 of the invention.

As illustrated in FIG. 5A, the notch 440 of the fuse 400 includes a lower-stage notch 441 provided on the lower-end side of an insulating housing 430, and an upper-stage notch 442 provided on and continuous to the lower-stage notch 441. The lower-stage notch 441 has a larger width than the upper-stage notch 442.

The protrusion 530 of the fuse box 500 includes a lower-stage protrusion 531 provided at the center of the bottom surface of a housing 520, an intermediate-stage protrusion 532 provided on and continuous to the lower-stage protrusion 531, and an upper-stage protrusion 533 provided on and continuous to the intermediate-stage protrusion 532.

The lower-stage notch 441 has a height and a width equal to the height and the width of the intermediate-stage protrusion 532. The upper-stage notch 442 has a height and a width equal to the height and the width of the upper-stage protrusion 533. Because of the identical shapes of the notch 440 and the protrusion 530, the protrusion 530 can be fitted in the notch 440, and the fuse 400 can be accordingly inserted in the housing 520.

By arranging the width of the upper-stage protrusion 533 to be equal to the width L1 of the upper-stage protrusion 232 of the fuse box 200 illustrated in FIG. 4, and the width of the intermediate-stage protrusion 532 to be larger than the width L1, it is prevented that the fuse 100 (see FIG. 4) different from the fuse 400 in characteristics is mistakenly inserted in the housing 520. More specifically, an attempt to insert the fuse 100 into the housing 520 fails because the notch 140 of the fuse 100 having the width L1 abuts against the upper end of the intermediate-stage protrusion 532 larger in width than the width L1. Therefore, the fuse 100 cannot be inserted in the housing 520 all the way to its bottom surface.

Modified Example 2

Hereinafter, a fuse 600 and a fuse box 700 according to another modified example are described referring to FIG. 5B, in which shapes of a notch and a protrusion are modified. The fuse 600 and the fuse box 700 respectively have a notch 640 and a protrusion 730 that are different, in shape, from the notch 140 of the fuse 100 and the protrusion 230 of the fuse box 200. Any other structural features of these fuse and fuse box are identical to those of the fuse 100 and the fuse box 200. Descriptions of identical structural features are omitted.

Figure 5B:
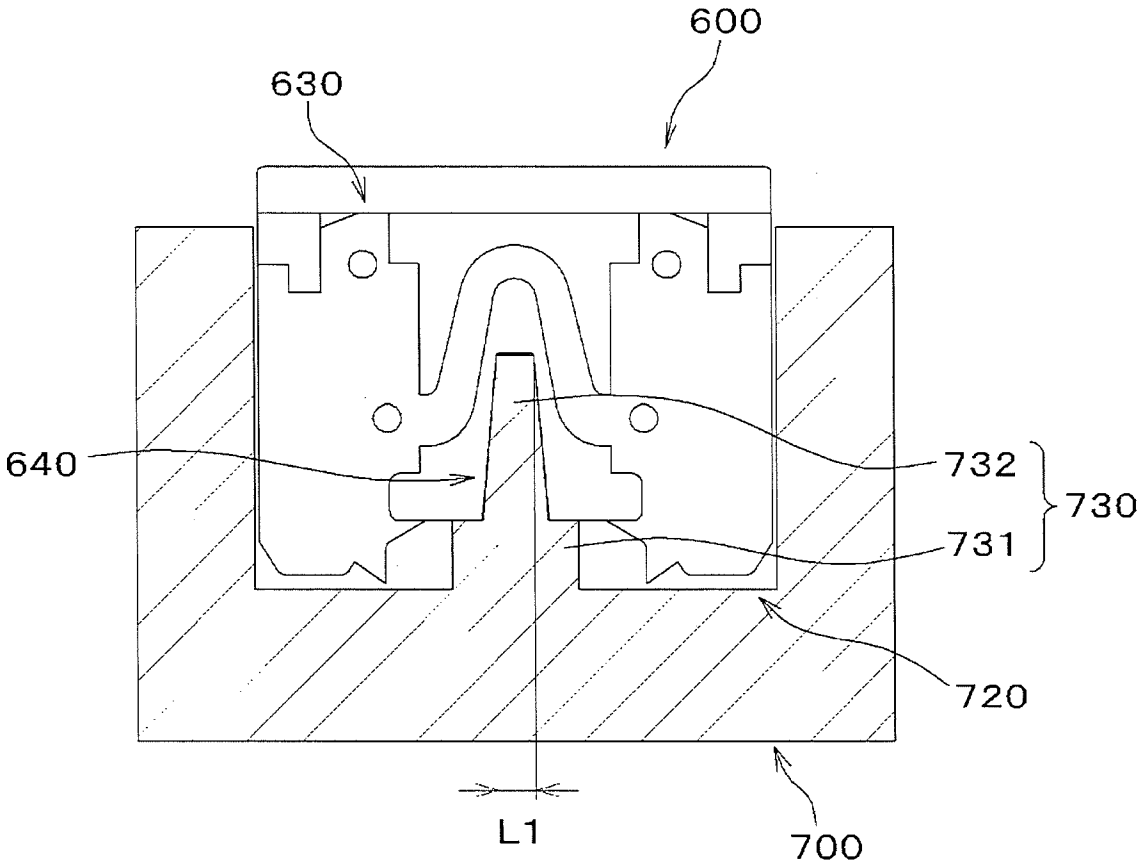
FIG. 5B is an enlarged view of a fuse and a fuse box according to a modified example 2 of the invention.

As illustrated in FIG. 5B, the notch 640 of the fuse 600 is provided on the lower-end side of an insulating housing 630 and has a substantially trapezoidal shape in longitudinal cross section that becomes larger in width toward its bottom. The protrusion 730 of the fuse box 700 includes a lower-stage protrusion 731 provided at the center of the bottom surface of a housing 720, and an upper-stage protrusion 732 provided on and continuous to the lower-stage protrusion 731. The upper-stage protrusion 732 has a substantially trapezoidal shape corresponding to the shape of the notch 640. Therefore, the protrusion 730 can be fitted in the notch 640, and the fuse 600 can be accordingly inserted in the housing 720.

In a case where, for example, the width on the upper-end side of the upper-stage protrusion 732 is arranged to be equal to the width L1 of the upper-stage protrusion 232 of the fuse box 200 illustrated in FIG. 4 and the width on the lower-end side of the upper-stage protrusion 732 is arranged to be larger than the width L1, it is prevented that the fuse 100 (see FIG. 4) different from the fuse 600 in characteristics is mistakenly inserted in the housing 720. More specifically, an attempt to insert the fuse 100 into the housing 720 fails because the notch 140 of the fuse 100 having the width L1 abuts against the side surfaces of the upper-stage protrusion 732 larger in width than the width L1. Therefore, the fuse 100 cannot be inserted in the housing 720 all the way to its bottom surface.

Thus providing different protrusions that are variously shaped is advantageous for inserting fuses with notches exactly corresponding in shape to the protrusions, and also advantageous for preventing insertion of any fuses with notches formed otherwise. Suitably modified protrusion shapes, as described in the modified examples 1 and 2, offer a broader range of fuses, fuse boxes, and fuse devices that can effectively prevent insertion of wrong products.

To desirably obtain a broader range of fuses that can prevent inserting wrong products, it is conventionally necessary to prepare different types of fuses in which the protrusion 931B is differently located and/or shaped as illustrated in FIG. 6C. Then, the upper end of the insulating housing inevitably changes its original shape, and the recesses for engaging a fuse clip cannot be ensured. As a result, engagement of the fuse clip is likely to fail. In contrast, to desirably obtain a broader range of fuses that can prevent inserting wrong products, the invention of this application, wherein the notch on the lower-end side of the insulating housing can be flexibly and arbitrarily modified in shape, promises engagement of a fuse clip with the recesses as conventionally done.

It is clear that the fuse, fuse box, and fuse device according to the invention of this application are not limited to the examples described thus far, and all the technical equivalents and modifications of the means described in the claims and examples, and their combinations fall within the technical scope of the invention.

What is claimed is:

1. A fuse, comprising:

a pair of electro-conductive terminals;

a fuse element having a fusion portion provided between the electro conductive terminals; and an insulating housing mounted so as to cover at least a part of the fusion portion and the electro-conductive terminals, wherein a notch pair is provided on a lower-end side of the insulating housing, the notch pair is located between the pair of electro-conductive terminals which are connected to each other by the fusion portion and at a position that does not interfere with the shape of the fusion portion provided between the pair of electro-conductive terminals, the notch pair is configured to correspond in shape to a protrusion integrally formed in a fuse box that is made of electrical insulating material, and the notch pair configured to vertically receive the protrusion integrally formed in the fuse box therethrough.

2. The fuse as claimed in claim 1, wherein the notch is located at a center position of the insulating housing.

3. A fuse box, comprising:

a housing adapted for housing a fuse therein; and a protrusion corresponding in shape to a notch of the fuse, wherein the protrusion is configured to fit in the notch of the fuse when the fuse is housed in the housing, and the fuse comprises a pair of electro-conductive terminals;

a fuse element having a fusion portion provided between the electro-conductive terminals; and an insulating housing mounted so as to cover at least a part of the fusion portion and the electro-conductive terminals, wherein the notch includes a front-side notch and rear-side notch that are provided on a lower-end side of the insulating housing, the notch is located between the pair of electro-conductive terminals which are connected to each other by the fusion portion and at a position that does not interfere with the shape of the fusion portion provided between the pair of electro-conductive terminals, and the notch is configured to correspond in shape to a protrusion integrally formed in a fuse box that is made of electrical insulating material, and the notch configured to vertically receive the protrusion integrally formed in the fuse box therethrough.

4. The fuse box of claim 3, wherein the notch is located at a center position of the insulating housing.

5. A fuse device, comprising the fuse of claim 1.

6. A fuse device, comprising the fuse box of claim 3.

7. The fuse device of claim 6, wherein the notch is located at a center position of the insulating housing.

* * * * *